United States Patent [19]

Habecker et al.

[11] Patent Number: 4,691,086

[45] Date of Patent: Sep. 1, 1987

[54] PUSHBUTTON ELECTRICAL SWITCH HAVING A FLAIRING CONTACTOR LOOSELY ROTATABLE ON A SPRING-BIASED EYELET

[75] Inventors: John W. Habecker, Zion; Charles E. Black, III, Mount Prospect, both of Ill.

[73] Assignee: Indak Manufacturing Corp., Northbrook, Ill.

[21] Appl. No.: 847,498

[22] Filed: Apr. 3, 1986

[51] Int. Cl.[4] ..... H01H 1/18; H01H 1/32; H01H 13/14

[52] U.S. Cl. ..... 200/159 R; 200/275; 200/16 A; 200/5 A; 200/241; 200/248

[58] Field of Search ..... 200/159 R, 159 A, 153 V, 200/239-242, 243, 245, 246, 293, 275, 250, 295, 5 A, 16 R, 5 R, 16 A, 340, 16 B, 248

[56] References Cited

U.S. PATENT DOCUMENTS

| | | | |
|---|---|---|---|
| 1,197,800 | 9/1916 | Cuno | 200/243 X |
| 2,951,916 | 9/1960 | Scheffer | 200/16 A |
| 3,054,879 | 1/1960 | Soreng | 200/159 R |
| 3,172,974 | 3/1965 | Perrino | 200/243 X |
| 3,749,873 | 7/1973 | Harper et al. | 200/293 |
| 3,924,090 | 12/1975 | Chao et al. | 200/159 A |
| 3,940,585 | 2/1976 | Schaad | 200/159 R |
| 4,052,580 | 10/1977 | Stanish | 200/159 R |
| 4,053,726 | 10/1977 | Schaad | 200/159 R |
| 4,129,763 | 12/1978 | Murata | 200/159 A |
| 4,164,636 | 8/1979 | Gallagher | 200/159 R X |
| 4,316,066 | 2/1982 | Muller et al. | 200/67 D |
| 4,370,533 | 1/1983 | Kamei et al. | 200/159 R X |
| 4,467,160 | 8/1984 | Murmann et al. | 200/159 A |
| 4,492,838 | 1/1985 | Fukukura | 200/159 A |

FOREIGN PATENT DOCUMENTS

| | | | |
|---|---|---|---|
| 1216717 | 4/1960 | France | 200/243 |
| 843867 | 8/1960 | United Kingdom | 200/159 A |

*Primary Examiner*—Stephen Marcus
*Assistant Examiner*—Ernest G. Cusick
*Attorney, Agent, or Firm*—Burmeister, York, Palmatier, Hamby & Jones

[57] ABSTRACT

The switch comprises a hollow, generally rectangular casing, a generally rectangular pushbutton slidable rearwardly in such casing, and a terminal supporting block closing the rear end of such casing. All of such components are made of moldable resinous plastic materials. The block carries forwardly projecting contact points which connect with external electrical terminals. The pushbutton carries a cup-shaped contactor, slidably and rotatably mounted on a retaining pin which is pressed into a hollow post projecting rearwardly from the pushbutton. A compression coil spring is mounted around the pin and the post, between the contactor and the pushbutton. The contactor is fitted with an axial eyelet on which the contactor is freely rotatable. The contactor is movable into wiping engagement with the contact points, when the pushbutton is pushed rearwardly against the biasing force of a coil spring, compressed between the pushbutton and the terminal supporting block. The casing has a pair of latching fingers with latching teeth which are slidable along guide grooves in the block. The latching teeth are spread apart by outward flexure of the latching fingers, until the latching teeth snap into latching recesses at the rear end of the grooves. The casing also has a pair of locating fingers, projecting rearwardly in a rectangular relationship with the latching fingers, and receivable in locating channels formed in the terminal supporting block. The casing and the block are easily assembled by pushing them together until the latching teeth snap into the latching recesses.

4 Claims, 33 Drawing Figures

48
132
158
44
46
142
13
14
52
140
122
121
124
50
123

PUSHBUTTON ELECTRICAL SWITCH HAVING A FLAIRING CONTACTOR LOOSELY ROTATABLE ON A SPRING-BIASED EYELET

FIELD OF THE INVENTION

This invention relates to a pushbutton electrical switch in which the pushbutton and the casing components are made of resinous plastic materials.

BACKGROUND OF THE INVENTION

Pushbutton electrical switches are, of course, known in the prior art. The present application is assigned to Indak Manufacturing Corp., which is also the assignee of certain prior U.S. patents disclosing pushbutton switches that, to some extent, are the technological ancestors of the present invention. Such U.S. patents include the Soreng U.S. Pat. No. 3,054,879, issued Sept. 18, 1962; the Schaad U.S. Pat. No. 3,940,585, issued Feb. 24, 1976; and the Schaad U.S. Pat. No. 4,053,726, issued Oct. 11, 1977.

The pushbutton switch of the present invention is intended primarily for automotive use, on automobiles, trucks and other types of motor vehicles, but the switch may find other applications.

OBJECTS OF THE INVENTION

One object of the present invention is to provide a new and improved pushbutton switch, in which the pushbutton and casing components are all made of resilient moldable resinous plastic materials, which are intricately moldable at extremely low cost, and which serve as electrically insulating materials.

A further object is to provide a new and improved pushbutton switch in which the pushbutton and the casing are generally rectangular in shape, and in which the casing is well adapted to be pushed into and retained in a rectangular opening formed in an automotive panel or the like.

Another object is to provide a new and improved pushbutton electrical switch, in which the pushbutton and the casing components are assembled very easily and quickly, without requiring the use of any tools or machines.

It is a further object to provide a new and improved pushbutton electrical switch, in which the pushbutton and casing components fit together very easily, but in only one orientation, so that improper assembly is impossible.

SUMMARY OF THE INVENTION

To achieve these and other objects, the present invention provides a pushbutton electrical switch, comprising an electrically insulating generally rectangular casing including a hollow generally rectangular casing sleeve having a generally rectangular axial opening therein, such sleeve having four boundary walls around such axial opening, a generally rectangular pushbutton slidably received in such opening for axial sliding movement therein, such pushbutton having a front portion initially projecting forwardly from the casing for manual rearward movement, the pushbutton including a rear portion having an electrically conductive contactor mounted thereon, a generally rectangular terminal head disposed to the rear of such casing and including an electrically insulating generally rectangular terminal supporting block having a plurality of electrically conductive contacts mounted thereon for circuit closing engagement by the contactor, such terminal head having rearwardly disposed electrical terminals mounted on such block and electrically connected with the contacts, resilient biasing means for biasing the pushbutton forwardly, the pushbutton being manually movable in a rearward direction against the action of the biasing means, the casing sleeve having a pair of oppositely related latching fingers projecting rearwardly from two of the boundary walls, the block having guide formations and latching formations for receiving the latching fingers in a latching relationship, the boundary walls including two other walls which are opposite each other and rectangularly related to the walls on which the latching fingers project rearwardly, and a pair of opposite locating fingers projecting rearwardly on such other walls, such block having locating portions for receiving such locating fingers, whereby the latching fingers and the locating fingers interlock with such block to retain the terminal head in an established position against the rear of the casing.

The pushbutton, the casing and the terminal supporting block are preferably made of a resinous plastic material which is intricately moldable, so that the parts can be molded at very low cost.

The guide formations for the latching fingers are preferably in the form of grooves formed in two opposite sides of the terminal supporting block. The latching fingers are preferably formed with latching teeth, adapted to interlock with the latching formations, which preferably are in the form of latching recesses in such block. Preferably, the latching fingers are flexible and resilient, so that the latching fingers can be spread apart, as the latching teeth are moved along the guide grooves, at the end of which the latching teeth snap into the latching recesses.

The locating portions for receiving the locating fingers are preferably in the form of locating channels in the terminal supporting block. The latching fingers and the locating fingers are rectangularly related, so that the terminal head is securely retained by the latching fingers against the rear of the casing.

Preferably, the terminal supporting block is formed with an axial recess, in which the contacts are mounted against the block. The locating channels for the locating fingers may open into portions of the axial recess. When the locating fingers are fully received in the channels, the locating fingers serve as enclosure elements for such portions of the axial recess.

The pushbutton and the casing are preferably formed with stop means for limiting the forward movement of the pushbutton. Such stop means may include laterally projecting tabs or other means, which are slidably received in channels. Preferably, such tabs project laterally from the pushbutton and are slidable along channels or slots in the casing sleeve. The tabs engage the front ends of the channels to limit the forward movement of the pushbutton.

The casing preferably has a laterally projecting front flange, adapted to engage a supporting panel in an automobile or the like. The terminal supporting block is preferably formed with flexible resilient retainer fingers which project forwardly toward the front flange and are adapted to be pushed through a rectangular opening in the panel, to retain the switch casing very securely in such opening.

The contactor is preferably cup-shaped and has an end wall with an annular side wall flaring therefrom, for wiping engagement with the contacts, which preferably are in the form of forwardly projecting contact points, engageable by the interior end portion of the flaring annular side wall on the contactor.

The pushbutton preferably has rearwardly projecting post means, including a resilient element for resiliently supporting the contactor. Preferably, the end wall of the contactor is formed with an axial aperture, which preferably has an eyelet loosely mounted therein, so that the contactor is rotatable relative to the eyelet. A headed retaining pin is preferably inserted through the eyelet and is pressed securely into a hollow post, projecting rearwardly on the pushbutton. A coil spring is positioned around the post and the pin, for resiliently biasing the contactor in a rearward direction. The coil spring engages the eyelet, which provides a rotatable and slightly loose mounting for the contactor. The head on the rear end of the pin retains the contactor.

The contact points preferably take the form of rivet heads having rivet shanks extending rearwardly through holes in the terminal supporting blocks. The electrical terminals are secured to the rivet shanks, as by upsetting the rear ends of the rivet shanks.

BRIEF DESCRIPTION OF THE DRAWINGS

Further objects, advantages and features of the present invention will appear from the following description of a preferred illustrative embodiment of the present invention, as depicted in the accompanying drawings, in which.

DETAILED DESCRIPTION OF AN ILLUSTRATIVE EMBODIMENT

Figure 4:
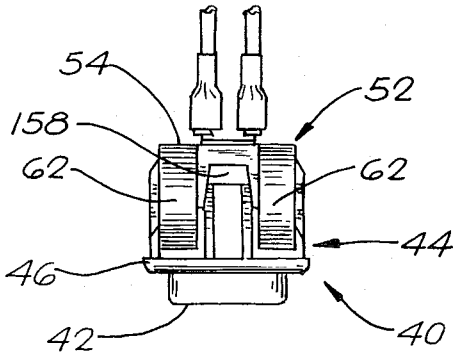
FIGS. 1, 2, 3 and 4 are side, front, top and rear views of a pushbutton switch to be described as a preferred illustrative embodiment of the present invention.
Figure 2:
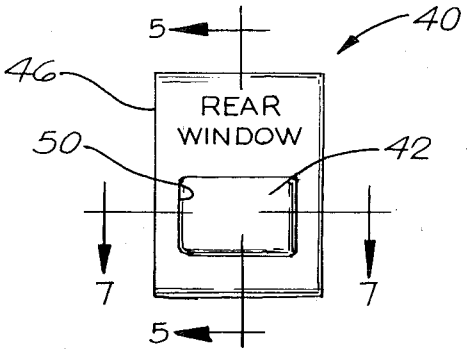
Figure 1:
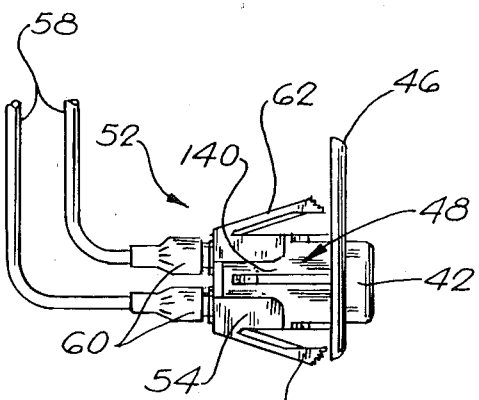
Figure 3:
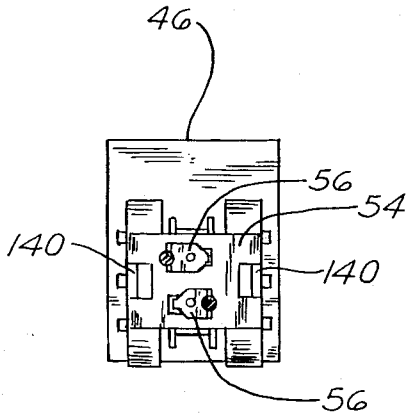

As just indicated, the drawings illustrate a preferred illustrative embodiment of the present invention, in the form of a pushbutton switch 40, intended primarily for automotive use, on automobiles, trucks and the like. The switch 40 may be employed to perform various functions as to which momentary switch operation is appropriate. Such functions include initiating the operation of a rear window defogger, unlatching a rear hatch door or window, and other similar operations.

FIGS. 1–4 show the external outlines of the pushbutton switch 40. As shown, the switch 40 has a generally rectangular pushbutton 42 which projects forwardly from a generally rectangular casing 44. A generally rectangular front flange 46 projects laterally from the casing 44 and is adapted to be mounted against a supporting panel, not shown, on an automobile or other vehicle. The casing 44 is adapted to extend rearwardly through a suitable rectangular opening in the panel.

The casing 44 comprises a hollow, generally rectangular casing sleeve 48 having a generally rectangular opening 50 in which the pushbutton 42 is slidably mounted. At the rear, the casing sleeve 48 is closed by a terminal head 52 having a generally rectangular terminal supporting block 54, adapted to interlock with the casing sleeve 48. The pushbutton 42, the casing 44 and the terminal supporting block 54 are all preferably made of electrically insulating materials, preferably strong, resilient, heat-resistant resinous plastic materials which are intricately moldable. For example, the pushbutton 42 and the casing 44 may be made of acetal plastic materials, such as Dupont Delrin, resistant to 250° F. The terminal supporting block 54 may be made of a reinforced nylon material, such as Dupont Zytel, reinforced with glass fibers and resistant to 450° F.

The terminal head 52 includes a plurality of electrical terminals 56 which are mounted on the supporting block 54 and project rearwardly therefrom. In this case, there are two such terminals 56. Insulated electrical wires or leads 58 are connected to the terminals 56. Electrically insulating sleeves 60 are mounted around the electrical terminals 56.

The switch 40 is provided with flexible resilient retainer fingers 62 which in this case are formed in one piece with the terminal supporting block 54. The fingers 62 slant outwardly and forwardly toward the front flange 46. As previously mentioned, the casing 44 is adapted to be pushed rearwardly through a rectangular opening in a supporting panel, not shown. When the casing 44 is pushed through the opening, the retainer fingers 62 are flexed toward the casing sleeve 48, until the fingers 62 pass through the opening, whereupon the fingers spring outwardly to retain the casing 44 in the opening.

The front flange 46 may be marked with a legend, such as the illustrated REAR WINDOW, to indicate the function of the switch 40.

Figure 5:
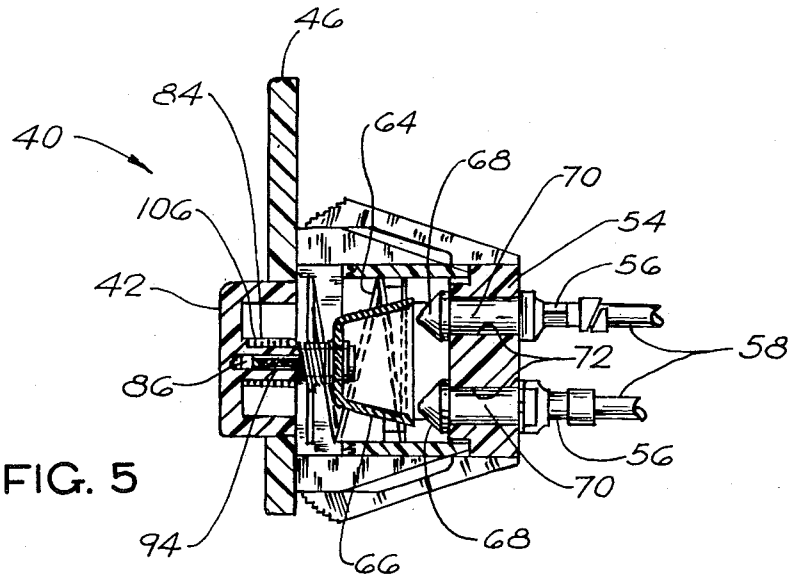
FIG. 5 is a vertical section, taken generally along the line 5—5 in FIG. 2, showing the pushbutton in its initial extended position, in which the pushbutton is not being pressed and the switch is open electrically.
Figure 6:
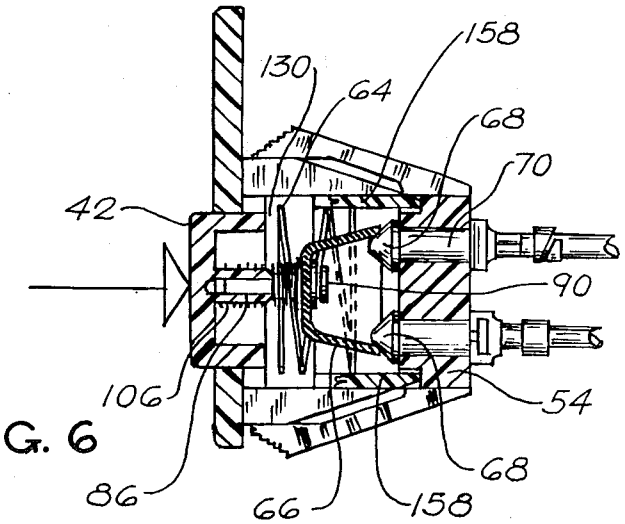
FIG. 6 is a vertical section, similar to FIG. 5, but with the pushbutton depressed, whereby the switch is closed electrically.
Figure 7:
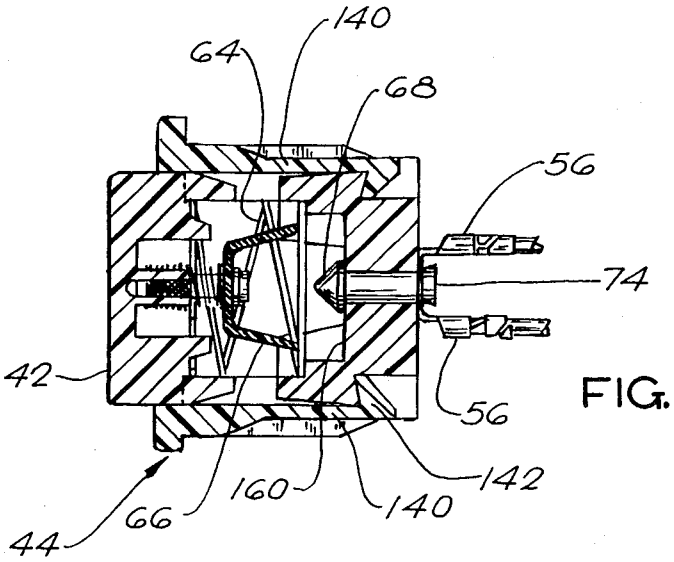
FIG. 7 is a horizontal section, taken generally along the ine 7—7 in FIG. 2, with the pushbutton in its initial extended position, in which the switch is open electrically.

As shown in FIGS. 5–8, the pushbutton switch 40 is provided with resilient biasing means for initially biasing the pushbutton 42 into its forwardly extended position, shown in FIGS. 5 and 7, such resilient biasing means being illustrated as a coil spring 64, compressed between the pushbutton 42 and the terminal supporting block 54. A contactor 66 is mounted on and carried by the rear side of the pushbutton 42, with a resilient connection therebetween. The contactor 66 is made of an electrically conductive material, such as copper.

Figure 8:
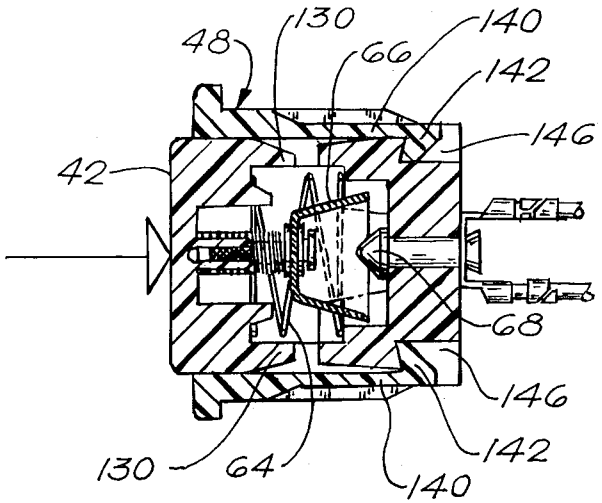
FIG. 8 is a horizontal section, similar to FIG. 7, but with the pushbutton depressed, so that the switch is closed electrically.

When the pushbutton 42 is depressed rearwardly, as shown in FIGS. 6 and 8, the contactor 66 engages a plurality of electrically conductive contacts 68, mounted on the supporting block 54. The switch 40 has two such contacts 68, which are illustrated as contact points, projecting forwardly from the supporting block 54. Preferably, the contact points 68 are conically tapered and rounded in shape, and also serve as rivet heads on the front ends of rivet shanks 70, extending through holes 72 in the supporting block 54. The contact points 68 and the rivet shanks 70 may be made of copper. The illustrated terminals 56 are apertured to receive the rivet shanks 70, which have upset rear ends 74 to clamp the terminals 56 against the supporting block 54.

When the contactor 66 is moved into engagement with the contact points 68, by the rearward depression of the pushbutton 42, as shown in FIGS. 6 and 8, the contactor 66 closes an electrical circuit between the contact points. When the pushbutton 42 is released, as shown in FIGS. 5 and 7, the contactor 66 is returned forwardly, out of engagement with the contact points 68, so that the circuit therebetween is opened.

Preferably, the contactor 66 is cup-shaped and conically tapered, as shown in FIGS. 28, 29, 30 and 33, as well as in FIGS. 5–8, to produce a wiping engagement between the contactor and the contact points 68. Preferably, the cup-shaped contactor 66 has an end wall 76 with a conically tapered annular side wall 78 flaring therefrom. The annular flaring side wall 78 has an interior annular skirt portion 80 which is rounded, for smooth wiping engagement with the contact points 68.

The end wall 76 of the contactor 66 has an axial aperture 82, for use in mounting the contactor on the rear side of the pushbutton 42. An axial, rearwardly projecting post 84 is preferably molded in one piece with the pushbutton 42. The post 84 is hollow and is formed with an axial aperture 86, as shown in FIGS. 24 and 25, as well as in FIGS. 5–8.

Figures 21, 22, 23, 24, 25, 26, 27, 28, 29, 30, 31, 32, 33:
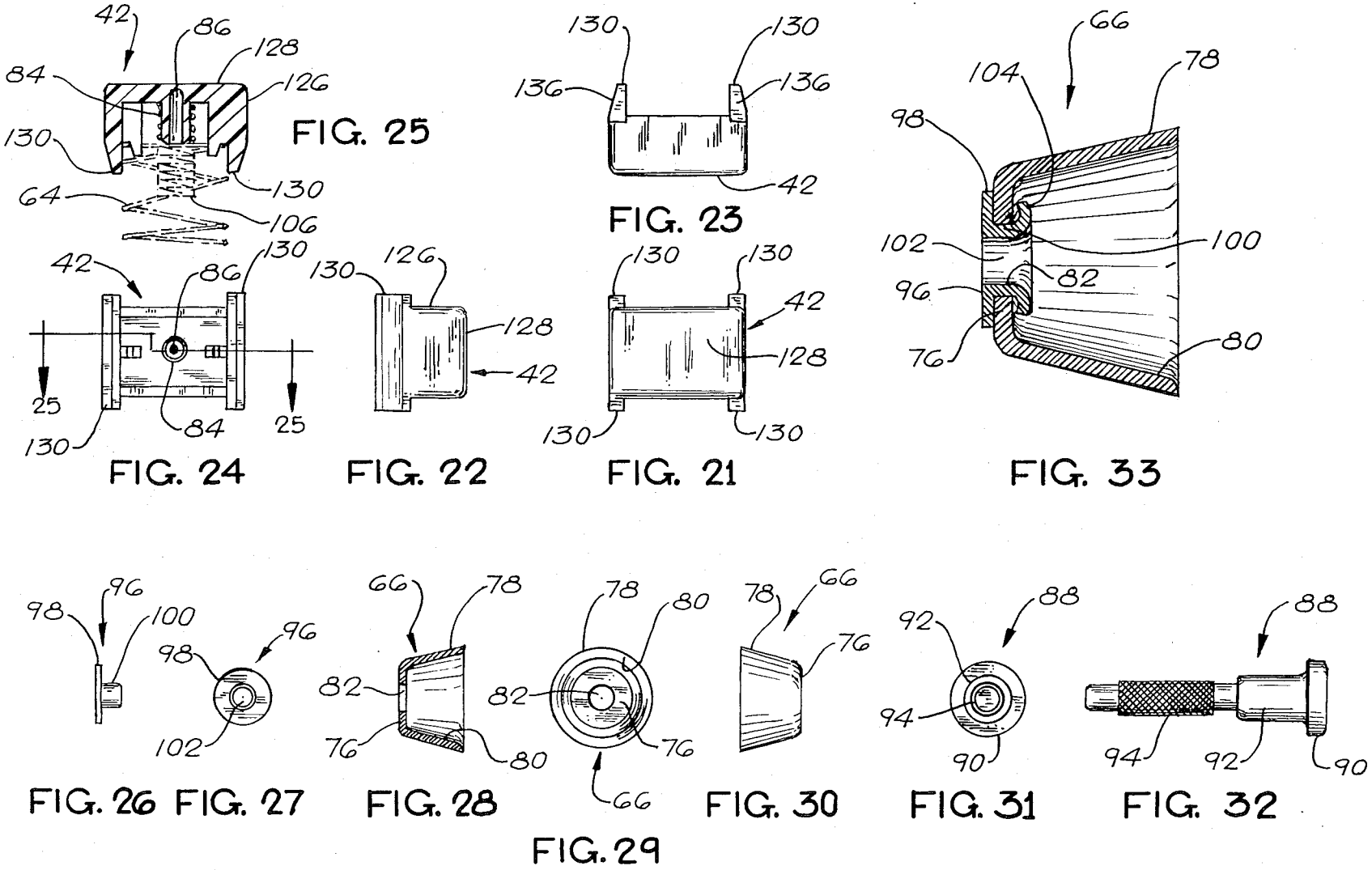
FIGS. 21, 22, 23 and 24 are front, side, top and rear views of the pushbutton for the switch of FIG. 1.
FIG. 25 is a horizontal section, taken generally along the line 25—25 in FIG. 24.
FIGS. 26 and 27 are side and end views of an eyelet employed in connection with the contactor for the switch of FIG. 1.
FIG. 28 is a central longitudinal section, taken through the contactor for the switch of FIG. 1.
FIG. 29 is an elevation, showing the open or rear end of the contactor.
FIG. 30 is a side elevation of the contactor.
FIGS. 31 and 32 are enlarged end and side elevations of a pin employed to retain the contactor on the rear end of the pushbutton for the switch of FIG. 1.
FIG. 33 is an enlarged sectional view, somewhat similar to FIG. 28, taken through the contactor, but showing the assembly of the eyelet with the contactor.

The contactor 66 is slidably and rotatably mounted on a retaining pin 88, shown in FIGS. 31 and 32, as well as in FIGS. 5–8. The pin 88 has an enlarged head 90, a smooth cylindrical shank portion 92, connected to the head 90, and a reduced end portion 94, connected to the smooth shank portion 92. The reduced end portion 94 is knurled or otherwise roughened, and is adapted to be pressed or driven into the axial aperture 86, formed in the post 84. Due to the knurling of the end portion 94, it is securely retained in the axial aperture 86.

Preferably, the aperture 82 in the end wall 76 of the contactor 66 is loosely fitted with an eyelet 96 which is freely rotatable in the aperture 82.

The eyelet 96 has a head or flange 98 and a hollow shank 100, with an axial opening 102 therein, for receiving the smooth cylindrical shank portion 92 of the retaining pin 88, with a loose slidable and rotatable fit therebetween. The loose fitting of the eyelet 96 on the shank portion 92 also provides for a substantial amount of wobbling or angular free play between the contactor 66 and the pin 88, so that the contactor is free to align itself with the contact points 68, when the contactor 66 is moved rearwardly into engagement with the contact points, as shown in FIG. 6. When the eyelet 96 is assembled with the contactor 66, as shown in FIG. 33, the flange 98 engages the exterior side of the end wall 76. The shank 100 extends loosely through the axial aperture 82. The end of the shank 100 is loosely upset or flared outwardly, to form a curled retaining flange 104, opposite the interior side of the end wall 76, within the cup-shaped contactor 66. The upsetting of the eyelet 96 is loose enough to provide for free rotation between the contactor 66 and the eyelet 96.

The contactor 66 is resiliently biased rearwardly, relative to the pushbutton 42, by resilient biasing means, illustrated as a coil spring 106, received around the post 84, and also around the smooth cylindrical shank portion 92 of the pin 88. The coil spring 106 is compressed between the pushbutton 42 and the eyelet 96, on which the contactor 66 is rotatably mounted. Initially, the spring 106 causes the curled flange 104 of the eyelet to engage the retaining head 90 of the pin 88.

When the pushbutton 42 is depressed rearwardly, as shown in FIGS. 6 and 8, the contactor 66 engages the contact points 68, so that the rearward movement of the contactor 66 is arrested. However, the pushbutton 42 is allowed a certain amount of rearward overtravel, relative to the contactor 66, until the rear end of the pushbutton 42 engages the front end of the terminal supporting block 54. With this arrangement, the coil spring 106 is interposed between the pushbutton 42 and the contactor 66, whereby the rearward force is exerted on the contactor 66 by the spring 106, and never directly by the pushbutton 42, so that the contactor cannot be damaged by heavy pressure, exerted on the pushbutton 42.

The coil spring 106 engages the eyelet 96 and thus does not interfere with the free rotatability of the contactor 66 relative to the eyelet. Due to such free rotatability, the wear between the contactor 66 and the contact points 68 tends to be distributed around the internal circumference 80 of the annular flaring contactor side wall 78.

The casing 44 and the terminal supporting block 54 interlock and snap together, so that these housing components can be assembled very easily, without the use of any tools. When the casing 44 and the terminal supporting block 54 are assembled, they are securely retainined together, in the desired orientation, without any looseness therebetween.

FIGS. 9–12 show additional details of the casing 44, with its rectangular front flange 46 and its generally rectangular casing sleeve 48. As shown, the casing sleeve 48 has four rectangularly related walls 121, 122, 123, and 124 which surround the generally rectangular opening 50, in which the pushbutton 42 is slidably received. The four walls 121–124 also act as slideway boundaries for the pushbutton 42.

Additional details of the pushbutton 42 are shown in FIGS. 21–25. It will be seen that the pushbutton 42 has a hollow, generally rectangular front portion 126 which is slidably received in the opening 50, formed in the casing 44. The front portion 126 has a substantially flat front wall 128, against which pressure is exerted to depress the pushbutton.

Toward its rear, the pushbutton 42 has tabs or flanges 130 which project laterally and rearwardly from the front portion 126, to act as stops for limiting the travel of the pushbutton 42.

Figures 9, 10, 11, 12, 13, 14:
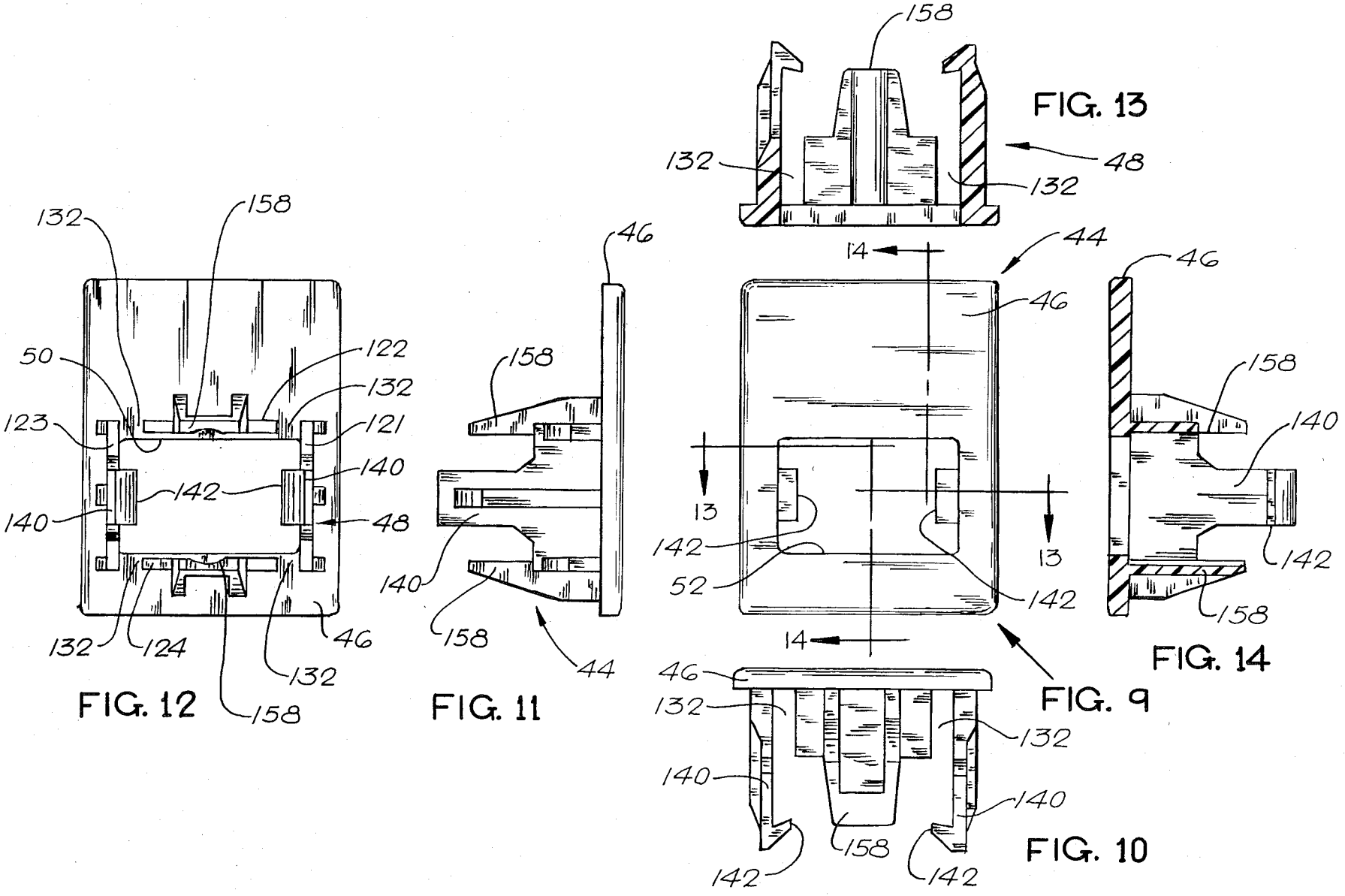
FIGS. 9, 10, 11 and 12 are front, bottom, side and rear views of the front housing component or casing for the electrical switch of FIG. 1.
FIG. 13 is a horizontal section, taken generally along the broken line 13—13 in FIG. 9.
FIG. 14 is a vertical section, taken generally along the broken line 14—14 in FIG. 9.
Figure 20:
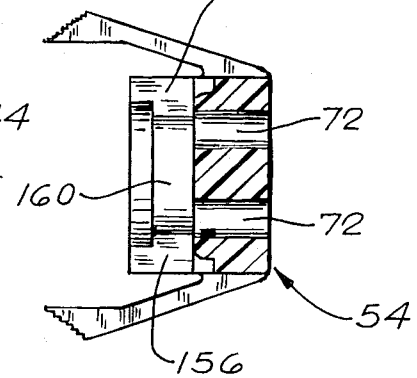
FIG. 20 is a vertical section, taken generally along the line 20—20 in FIG. 15.
Figure 15:
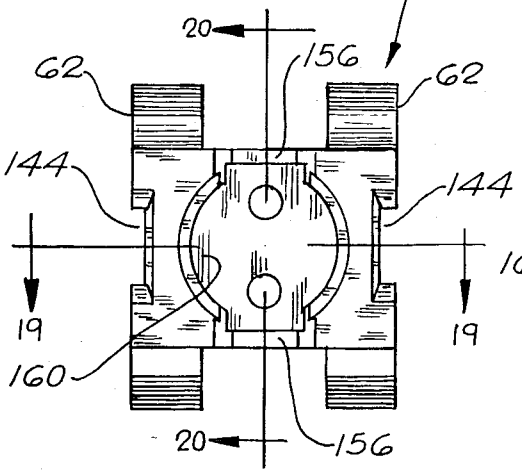
FIGS. 15, 16, 17 and 18 are front, side, bottom and rear views of the terminal supporting block, constituting the rear housing or casing component for the switch of FIG. 1.
Figure 17:
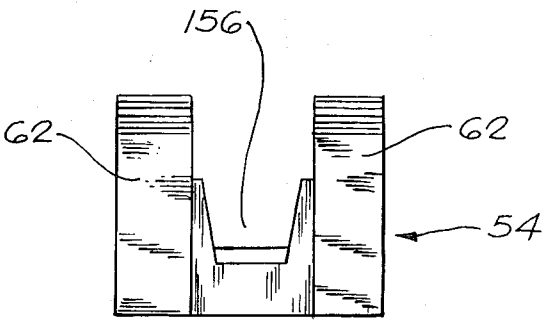
Figure 16:
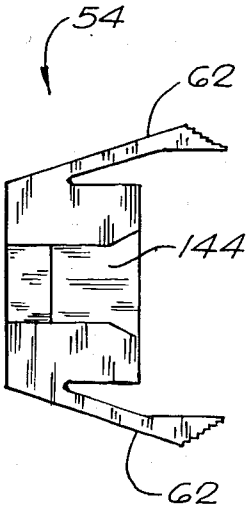
Figure 18:
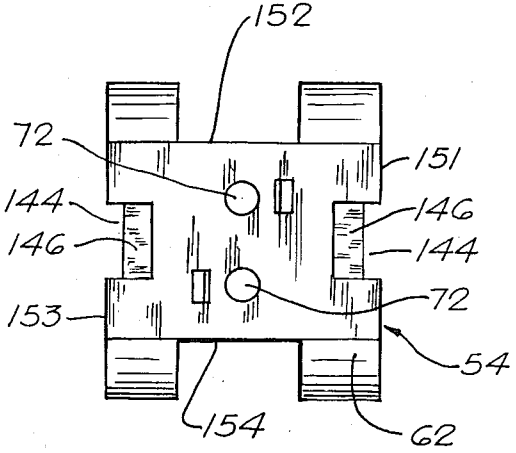
Figure 19:
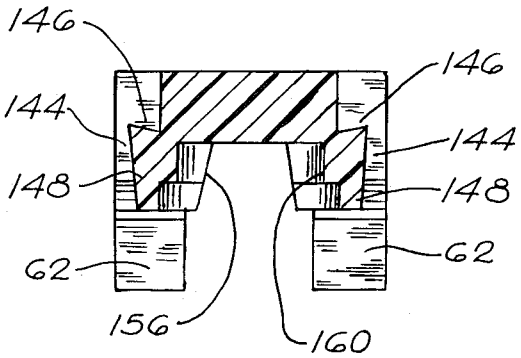
FIG. 19 is a horizontal section, taken generally along the line 19—19 in FIG. 15.

As shown in FIGS. 10, 12 and 13, the diametrically opposite side walls 122 and 124 of the casing sleeve 48 are formed with channels or slots 132 for slidably receiving the tabs 130 on the pushbutton 42. The front ends of the slots 132 are closed by the front flange or plate 46 of the casing, so as to limit the forward travel of the pushbutton 42. The rear ends of the slots 132 are open, so that the tabs 130 can be inserted into the slots 132, when the pushbutton 42 is assembled with the casing 44. When the switch 40 is fully assembled, the rear ends of the slots 132 are closed by the terminal supporting block 54, which is engageable by the tabs 130, to limit the rearward travel of the pushbutton 42, when the pushbutton is fully depressed. The tabs 130 have tapered sides 136, to insure that the pushbutton 42 will be freely slidable, without any binding, regardless of where the rearward operating pressure is applied to the pushbutton 42.

The casing 44 and the terminal supporting block 54 are provided with latching means for latching these components together, when they are pushed into engagement. As shown in FIGS. 9–14, the illustrated casing 44 comprises a pair of opposed latching fingers 140, projecting rearwardly on the opposite side walls 121 and 123 of the casing sleeve 48, such walls and such fingers being molded in one piece with the casing 44. Opposed latching teeth 142 project inwardly toward each other, on the rear ends of the latching fingers 140.

Details of the terminal supporting block 54 are shown in FIGS. 15–20. The block 54 has guide formations in the form of channels or grooves 144 for slidably receiving the latching fingers 140. Latching elements in the form of latching recesses 146 are provided in the block 54 at the rear ends of the grooves 144.

When the casing 44 and the terminal block 54 are pushed together, the latching teeth 142 are spread apart as they slide rearwardly along the grooves 144. The latching fingers 140 are flexible and resilient, to provide for such spreading movement of the latching teeth. As the casing 44 and the block 54 come together, the latching teeth 142 snap into the latching recesses 146, so that the casing and the block are latched securely together. To facilitate the assembly of the casing 44 and the block 54, the grooves 144 have slanted bottom surfaces 148 which act as ramps to spread the latching teeth 142 by causing flexure of the latching fingers 140.

The terminal supporting block 54 is generally rectangular and is provided with four rectangularly related side walls 151, 152, 153 and 154. The grooves 144 and the latching recesses 146 are formed in the opposite side walls 151 and 153. The other side walls 152 and 154 are provided with locating portions in the form of channels 156 for receiving a pair of locating fingers 158, projecting rearwardly from the side walls 122 and 124 of the casing sleeve 48.

The locating fingers 158 are tapered in width, and the channels 156 are correspondingly tapered. Thus, the locating fingers 158 are movable smoothly and easily into the channels 156, and serve as closures, occupying the channels 156, when the switch is fully assembled.

The front side of the terminal supporting block 54 is preferably formed with an axial recess 160 which is generally circular in shape. The contact points 68 are mounted in the axial recess 160. It will be seen from FIGS. 15, 17 and 20 that the locating channels 156 open into the axial recess 160. The locating fingers 158, when seated in the channels 156, serve as closure walls for the axial recess 160.

In the assembly of the switch 40, the pushbutton 42 and the contactor 66 are assembled as a subassembly, along with the retainer pin 88, the eyelet 98 and the coil spring 106. The eyelet 96 is assembled with the contactor 66, as previously described and as illustrated in FIG. 33. The coil spring 106 is slipped around the rearwardly projecting post 84 on the pushbutton 42. The pin 88 is then slipped through the opening 102 in the eyelet 96, and the knurled portion 94 of the pin 88 is pressed into the axial aperture 86 in the post 84.

The terminal head 52 is assembled as a subassembly by mounting the contact points 68 and the electrical terminals 56 thereon, as previously described.

To complete the final assembly, the pushbutton 42 is inserted into the rear of the casing 44, so that the pushbutton is extended forwardly through the opening 50. The coil spring 64 is then inserted into the casing 44, around the contactor 66 and against the rear side of the pushbutton 42.

Finally, the casing 44 and the terminal head 52 are assembled by aligning the latching teeth 142 with the guide grooves 144 in the terminal supporting block 54. As the latching teeth 142 are pushed into and along the guide grooves 144, the latching fingers 140 are flexed outwardly, as the latching teeth 142 are spread apart. As the latching teeth 142 reach the rear ends of the guide grooves 144, the teeth snap into the latching recesses 146, so that the casing 44 and the terminal head 52 are locked together. At the same time, the locating fingers 158 are fully seated in the locating channels 156, to insure that the casing 44 and the terminal head 52 will be maintained in the desired alignment. The coil spring 64 takes up any slack and obviates any looseness between the casing 44 and the terminal head 52.

It is easy to assemble the casing 44 and the terminal head 52, without the use of any tools. It is impossible to assemble the components 44 and 52 incorrectly, because the correct orientation between the components is established by the reception of the latching teeth 142 in the guide grooves, and by the reception of the locating fingers 158 in the locating channels 156.

Various modifications, alternative constructions and equivalents may be provided, within the true scope of the following claims.

We claim:

1. A pushbutton electrical switch, comprising a casing having front and rear components with means for securing said components togther, said front component including a hollow casing sleeve with a front end having a guide opening therein extending out of said casing and away from said rear component, a pushbutton slidably received in said guide opening for sliding movement therein toward and away from said rear component, said pushbutton having a front portion for manual movement of said pushbutton toward said rear component, said pushbutton including a rear portion having an electrically conductive contactor mounted thereon, said rear portion of said pushbutton including an axial generally cylindrical pin structure projecting in said casing toward said rear component for supporting said contactor, said contactor being generally cup-shaped with a front end wall and a hollow annular side wall projecting from said end wall toward said rear component, said annular side wall having an interior annular surface flaring away from said end wall, said end wall of said contactor having an axial substantially circular aperture therein, an eyelet loosely and rotatably received in said aperture, said eyelet having a tubular substantially cylindrical shank portion loosely and rotatably received in said aperture, said eyelet having a front end flange projecting generally radially outwardly from said shank portion in front of said end wall for loosely rotatable engagement therewith, said eyelet having a rear end flange projecting generally radially outwardly from said shank portion to the rear of said end wall for loose rotatable engagement therewith, said shank portion of said eyelet having a substantially circular and tubular opening therein loosely received around said pin structure with a loosely slidable and rotatable fit therebetween, said pin structure having means forming a rear retaining element projecting generally radially outwardly thereon for abutting engagement by said rear end flange of said eyelet, a compression coil spring received around said pin structure in front of said eyelet and compressed between said rear portion of said pushbutton and said front end flange of said eyelet for biasing said eyelet toward and against said rear retaining element, said rear retaining element being free and clear of said contactor, said coil spring being free and clear of said contactor whereby said contactor has free unimpeded rotatability relative to said eyelet, said rear component of said casing comprising a terminal head including an electrically insulating member having a front portion facing toward said contactor but spaced therefrom, said terminal head having a plurality of electrically conductive contact points mounted on said front portion of said electrically insulating member and projecting therefrom toward said interior annular surface of said contactor, said terminal head having exterior electrically conductive terminals connected to said contact points, and a second compression coil spring disposed in said casing and spaced away from said contactor for biasing said pushbutton away from said terminal head, said pushbutton being manually movable toward said terminal head against the biasing action of said second coil spring to bring said interior annular surface of said contactor into wiping engagement with said contact points for connecting them together electrically, said contactor being self-aligning with said contact points due to the free unimpeded rotatability of said contactor relative to said eyelet and also due to the loose slidability and rotatability of said eyelet relative to said pin structure, the free unimpeded rotatability of said contactor relative to said eyelet tending to cause distribution and equalization of wear on said contactor due to repeated engagement between said contactor and said contact points.

2. A pushbutton electrical switch according to claim 1, in which said pin structure comprises a hollow axial post on said portion of said pushbutton and projecting in said casing toward said rear component, and a generally cylindrical pin having a front portion securely received in said hollow axial post, said shank portion of said eyelet loosely received aroung said pin with a loosely slidable and rotatable fit therebetween.

3. A pushbutton electrical switch according to claim 2, in which said pin includes a rear portion affording a radially enlarged head forming said rear retaining element for abutting engagement by said rear end flange of said eyelet.

4. A pushbutton electrical switch according to claim 2, in which said pushbutton and said hollow axial post are made in one piece of an electrically insulating material.

* * * * *